US011067923B2

(12) United States Patent
Shimizu et al.

(10) Patent No.: US 11,067,923 B2
(45) Date of Patent: Jul. 20, 2021

(54) IMAGE FORMING APPARATUS CAPABLE OF PREDICTING THE LEVEL OF OCCURRENCE OF A TRANSFER MEMORY AND THE CAUSE OF OCCURRENCE THEREOF

(71) Applicant: KYOCERA Document Solutions Inc., Osaka (JP)

(72) Inventors: Tamotsu Shimizu, Osaka (JP); Takahiro Okubo, Osaka (JP); Mitsuhiro Hashimoto, Osaka (JP); Kazuhiro Nakachi, Osaka (JP); Shiro Kaneko, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/984,788

(22) Filed: Aug. 4, 2020

(65) Prior Publication Data

US 2021/0041808 A1 Feb. 11, 2021

(30) Foreign Application Priority Data

Aug. 9, 2019 (JP) ..... JP2019-147682

(51) Int. Cl.
*G03G 15/16* (2006.01)
*G03G 15/20* (2006.01)
*G03G 15/00* (2006.01)

(52) U.S. Cl.
CPC ..... *G03G 15/1645* (2013.01); *G03G 15/2053* (2013.01); *G03G 15/5037* (2013.01)

(58) Field of Classification Search
CPC ..... G03G 15/0266; G03G 15/0907; G03G 15/1645; G03G 15/2053; G03G 15/5037; G03G 2215/0607
(Continued)

(56) References Cited

U.S. PATENT DOCUMENTS 8,275,273 B2 * 9/2012 Thayer ..... G03G 15/5058 399/34
8,285,164 B2 * 10/2012 Imura ..... G03G 15/0806 399/55
(Continued)

FOREIGN PATENT DOCUMENTS

JP 2006-72208 A 3/2006

*Primary Examiner* — Hoan H Tran
(74) *Attorney, Agent, or Firm* — Stein IP, LLC

(57) ABSTRACT

An image forming apparatus includes an image forming portion, a high-voltage generation circuit, a current detection portion and a control portion. The image forming portion includes an image carrying member, a charging device, an exposure device and a developing device which includes a developer carrying member for carrying a two-component developer. The control portion can perform a transfer memory prediction mode that includes a step of estimating, when a first reference image is formed, the level of occurrence of transfer memory based on the direct-current component of a development current flowing through the developer carrying member and a step of measuring, when the measured direct-current component of the development current is larger than a predetermined value, the amount of charge of the toner within the developing device and estimating the cause of occurrence of the transfer memory based on the measured amount of charge of the toner.

8 Claims, 7 Drawing Sheets

(58) Field of Classification Search
USPC ..... 399/53–56, 66
See application file for complete search history.

(56) References Cited

U.S. PATENT DOCUMENTS 9,207,565 B2 * 12/2015 Shimizu ..... G03G 15/065
9,880,485 B2 * 1/2018 Kagawa ..... G03G 15/0189

* cited by examiner

IMAGE FORMING APPARATUS CAPABLE OF PREDICTING THE LEVEL OF OCCURRENCE OF A TRANSFER MEMORY AND THE CAUSE OF OCCURRENCE THEREOF

INCORPORATION BY REFERENCE

This application is based upon and claims the benefit of priority from the corresponding Japanese Patent Application No. 2019-147682 filed on Aug. 9, 2019, the entire contents of which are incorporated herein by reference.

BACKGROUND

The present disclosure relates to image forming apparatuses, such as a copying machine, a printer, a facsimile machine and a multifunctional peripheral thereof, which include an image carrying member, and particularly relates to a method of reducing transfer memory in which a previously printed image appears as a left image on the subsequent image.

In an image forming apparatus using an electrophotographic process, the following process is generally performed, a photosensitive layer on the surface of a photosensitive drum (image carrying member) is charged with a charging device so as to have a predetermined surface potential (the same polarity as the charging polarity of a toner), and thereafter an electrostatic latent image is formed on the photosensitive drum with an exposure device. Then, the formed electrostatic latent image is visualized with a toner within a developing device. Furthermore, the toner image thereof is transferred on a recording medium which is passed through a nip portion (transfer nip portion) between the photosensitive drum and a transfer member that makes contact with the photosensitive drum, and thereafter fixing processing is performed. Here, a step of transferring the toner image to the recoding medium is performed in a state where a transfer voltage whose polarity is opposite to the charging polarity of the toner is applied to the transfer member.

In the image forming apparatus as described above, after the photosensitive drum is rotated one revolution, an image resulting from a previous image pattern may appear on the subsequent image. This is called transfer memory (photosensitive drum memory). FIG. 8 is a schematic view showing the surface potentials of an image portion and a white background portion (non-exposure portion) in the individual steps of development, transfer and charging. FIG. 8 shows a case where both the surface potential of the photosensitive drum and the charging polarity of the toner are positive (plus).

In the development step shown in FIG. 8A, the surface potential VL of the image portion (exposure portion) is set low (20V), and the surface potential V0 of the white background portion (non-exposure portion) is set high (280V). When in this state, a development voltage Vdc (200V) is applied to a developing roller, since the surface potential V0 of the white background portion is higher than Vdc, the toner is not adhered. On the other hand, since the surface potential VL of the image portion is lower than Vdc, the toner corresponding to a development potential difference (Vdc−VL) is adhered.

When the transfer step shown in FIG. 8B is entered, the transfer voltage whose polarity is opposite (minus) to the toner is applied to the image portion and the white background portion. In the image portion, a toner layer serves as a resistance layer, and thus only a small amount of transfer current flows through the photosensitive drum. On the other hand, in the white background portion, the toner layer is not present, and thus a large amount of transfer current flows. Consequently, the surface potentials of the image portion and the white background portion are reversed, and thus the white background portion is lower in surface potential than the image portion. Thereafter, although a static elimination step of removing charge left on the surface of the photosensitive drum is entered, the order of the surface potentials (image portion<white background portion) is not changed.

Since the order of the surface potentials is not changed even when the charging step is entered in the subsequent round of image formation, as shown in FIG. 8C, a portion which was the image portion at the time of the previous round of image formation is higher in surface potential than a portion which was the white background portion. As described above, since the surface potential V0 at the time of the subsequent round of image formation is changed by a history at the time of the previous round of image formation, when a half image or the like is printed, the surface potential VL of the portion which was the image portion at the time of the previous round of image formation is higher than that of the portion which was the white background portion. Consequently, the development potential difference (Vdc−VL) of the portion which was the image portion at the time of the previous round of image formation is decreased, and thus an image density is lowered.

It is found that the transfer memory as described above occurs when a development current easily flows. The time when the development current easily flow is, for example, a time when in a two-component development type using a two-component developer including a carrier and a toner, a coat layer on the surface of the carrier is scraped such that a carrier current is increased. In a one-component development type using a one-component developer formed of only a toner, the time when the development current easily flow is a time when the movement of the toner is activated such that a development space current is increased. Furthermore, regardless of a development type, the development current easily flows under a high-humidity environment.

FIG. 9 is a schematic view showing the surface potentials of the image portion and the white background portion (non-exposure portion) in the individual steps of development, transfer and charging when the development current easily flows. When the development current is increased, the surface potential of the photosensitive drum is changed. Specifically, in the development step shown in FIG. 9A, the surface potential of the white background portion is lowered by the flow of the development current thereinto, and the surface potential of the image portion is increased. In other words, both the potentials of the image portion and the white background portion are changed so as to approach the direct-current component (Vdc) of the development voltage. The amount of change in the surface potential of the image portion is larger because the amount of charge injected from the development current is larger, with the result that the potential difference between the white background portion and the image portion is decreased by the increase in the development current.

Then, in the transfer step shown in FIG. 9B, a large amount of transfer current flows into the white background portion as compared with the image portion, and thus a surface potential difference is produced. Consequently, the latent image potential of the white background portion is significantly lowered, and since the toner layer serves as resistance, the latent image potential of the image portion is slightly lowered. This surface potential difference is maintained in the charging step shown in FIG. 9C, and thus the portion which was the image portion at the time of the previous round of image formation is higher in surface potential than the portion which was the white background portion. The width of the reverse of the surface potential is increased as compared with a case where the development current is unlikely to flow (is low).

Hence, even when conditions under which the transfer memory is prevented from occurring are set at the beginning of use of the image forming apparatus, the transfer memory occurs when the development current is increased.

Hence, a method of reducing the occurrence of the transfer memory is proposed, and an image forming apparatus described below is known. In the image forming apparatus, at the time of non-paper passage when a recording material is not present in a transfer part where an image carrying member and a transfer means making contact with the image carrying member are brought into contact with each other, constant current control is performed on the transfer means with a set current, and according to a voltage at that time, the conveying interval of the recording material is changed or constant voltage control is performed on the transfer means with a set voltage, and when the voltage at that time does not reach a predetermined value, the conveying interval of the recording material is increased.

SUMMARY

An image forming apparatus according to one aspect of the present disclosure includes an image forming portion, a high-voltage generation circuit, a current detection portion and a control portion. The image forming portion includes an image carrying member in which a photosensitive layer is formed on a surface, a charging device which charges the image carrying member, an exposure device which exposes the image carrying member charged with the charging device so as to form an electrostatic latent image and a developing device which includes a developer carrying member that is arranged opposite the image carrying member and that carries a developer including a toner and which adheres the toner to the electrostatic latent image formed on the image carrying member so as to form a toner image. The high-voltage generation circuit applies, to the developer carrying member, a development voltage in which an alternating-current voltage is superimposed on a direct-current voltage. The current detection portion detects a direct-current component of a development current which flows when the development voltage is applied to the developer carrying member. The control portion controls the image forming portion and the high-voltage generation circuit. The control portion can perform a transfer memory prediction mode that includes a step of estimating, when a first reference image is formed, the level of occurrence of transfer memory based on the direct-current component of the development current flowing through the developer carrying member and a step of measuring, when the measured direct-current component of the development current is larger than a predetermined value, the amount of charge of the toner within the developing device and estimating the cause of occurrence of the transfer memory based on the measured amount of charge of the toner.

Further other objects of the present disclosure and specific advantages obtained by the present disclosure will become more apparent from the description of an embodiment given below.

DETAILED DESCRIPTION

Figure 1:
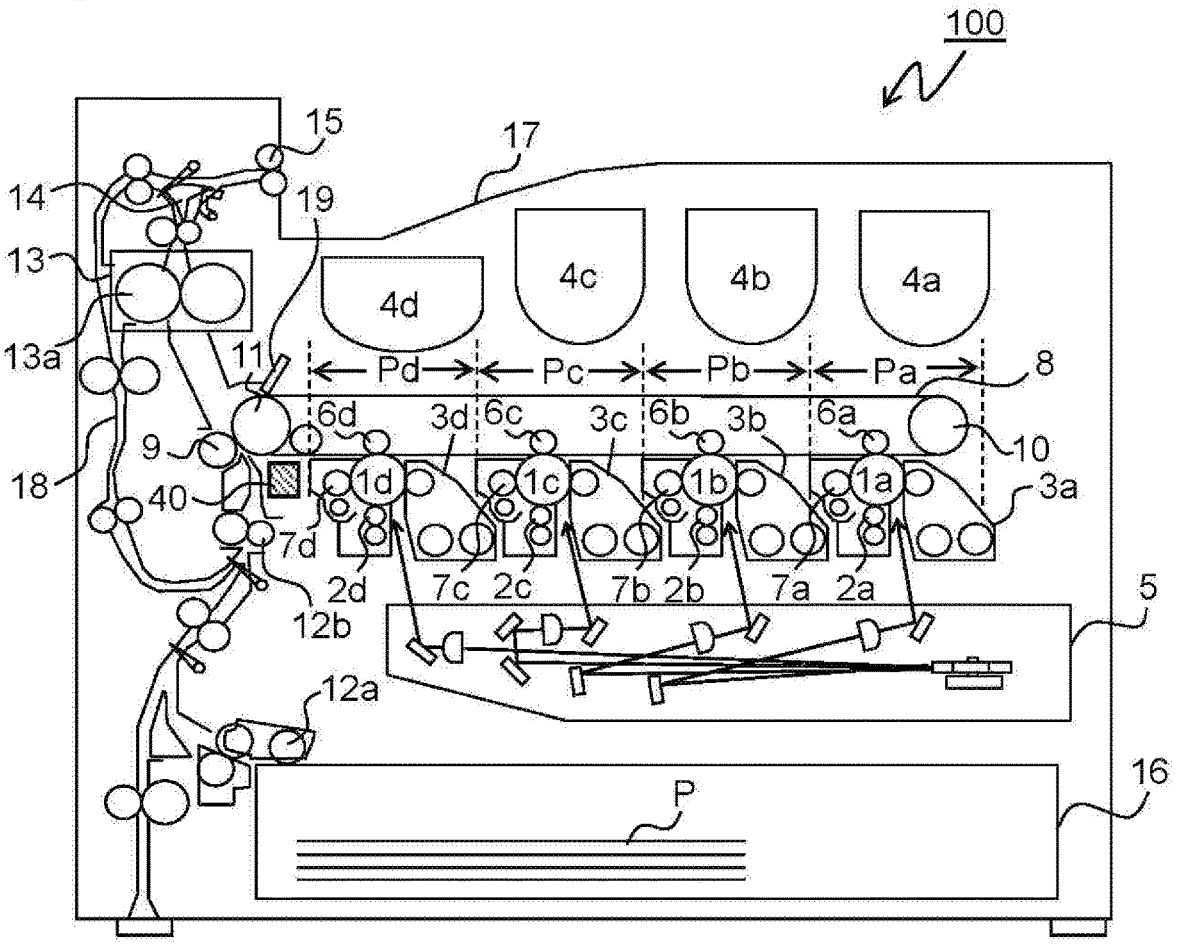
FIG. 1 is a side cross-sectional view showing an internal configuration of an image forming apparatus according to an embodiment of the present disclosure.

An embodiment of the present disclosure will be described below with reference to drawings. FIG. 1 is a cross-sectional view showing an internal structure of an image forming apparatus 100 according to an embodiment of the present disclosure. Within the main body of the image forming apparatus 100 (here, a color printer), four image forming portions Pa, Pb, Pc and Pd are arranged sequentially from an upstream side in a conveying direction (right side in FIG. 1). These image formation portions Pa to Pd are provided so as to correspond to images of four different colors (cyan, magenta, yellow and black), and the images of cyan, magenta, yellow and black are sequentially formed in the individual steps of charging, exposure, developing and transfer.

In these image forming portions Pa to Pd, photosensitive drums (image carrying members) 1*a*, 1*b*, 1*c* and 1*d* are arranged which carry visible images (toner images) of the individual colors. Furthermore, an intermediate transfer belt (intermediate transfer member) 8 which is rotated in the clockwise direction of FIG. 1 with a drive means (not shown) is provided adjacent to the image forming portions Pa to Pd. The toner images formed on these photosensitive drums 1*a* to 1*d* are sequentially primarily transferred on the intermediate transfer belt 8 which is moved while making contact with the photosensitive drums 1*a* to 1*d* so as to be superimposed on each other. Thereafter, the toner images primarily transferred on the intermediate transfer belt 8 are secondarily transferred with a secondary transfer roller 9 on transfer paper P which is an example of a recording medium. Furthermore, the transfer paper P on which the toner images are secondarily transferred is ejected from the main body of the image forming apparatus 100 after the toner images are fixed in a fixing portion 13. While the photosensitive drums 1*a* to 1*d* are being rotated in the counterclockwise direction of FIG. 1, an image formation process is performed on the individual photosensitive drums 1*a* to 1*d*.

The transfer paper P on which the toner images are secondarily transferred is stored within a sheet cassette 16 which is arranged in a lower portion of the main body of the image forming apparatus 100. The transfer paper P is conveyed through a paper feed roller 12*a* and a registration roller pair 12*b* to a nip portion between the secondary transfer roller 9 and a drive roller 11 for the intermediate transfer belt 8. As the intermediate transfer belt 8, a sheet which is formed of a dielectric resin is used, and a (seamless) belt which has no seam is mainly used. On the downstream side of the secondary transfer roller 9, a blade-shaped belt cleaner 19 is arranged which removes the toners and the like left on the surface of the intermediate transfer belt 8.

The image forming portions Pa to Pd will then be described. Around and below the photosensitive drums 1*a* to 1*d* which are rotatably arranged, charging devices 2*a*, 2*b*, 2*c* and 2*d* which charge the photosensitive drums 1*a* to 1*d*, an exposure device 5 which exposes the photosensitive drums 1*a* to 1*d* based on image information, developing devices 3*a*, 3*b*, 3*c* and 3*d* which form the toner images on the photosensitive drums 1*a* to 1*d* and cleaning devices 7*a*, 7*b*, 7*c* and 7*d* which remove developers (toners) and the like left on the photosensitive drums 1*a* to 1*d* are provided.

When image data is input from a host device such as a personal computer, the charging devices 2*a* to 2*d* first uniformly charge the surfaces of the photosensitive drums 1*a* to 1*d*. Then, the exposure device 5 applies light according to the image data so as to form electrostatic latent images corresponding to the image data on the photosensitive drums 1*a* to 1*d*. Predetermined amounts of two-component developers which include the toners of the individual colors of cyan, magenta, yellow and black are respectively charged into the developing devices 3*a* to 3*d*. When the proportions of the toners in the two-component developers charged within the developing devices 3*a* to 3*d* fall below specified values by the formation of the toner images which will be described later, the developing devices 3*a* to 3*d* are replenished with the toners from toner containers 4*a* to 4*d*. The toners in the developers are supplied with the developing devices 3*a* to 3*d* on the photosensitive drums 1*a* to 1*d* and are electrostatically adhered so as to form the toner images corresponding to the electrostatic latent images formed by the exposure of the exposure device 5.

Then, with primary transfer rollers 6*a* to 6*d*, electric fields are provided between the primary transfer rollers 6*a* to 6*d* and the photosensitive drums 1*a* to 1*d* with a predetermined transfer voltage, and thus the toner images of cyan, magenta, yellow and black on the photosensitive drums 1*a* to 1*d* are primarily transferred on the intermediate transfer belt 8. These images of the four colors are formed so as to have a previously determined positional relationship for the formation of a predetermined full-color image. Thereafter, in order to prepare for the formation of new electrostatic latent images which will be continuously performed, the toners and the like left on the surfaces of the photosensitive drums 1*a* to 1*d* are removed with the cleaning devices 7*a* to 7*d* after the primary transfer.

The intermediate transfer belt 8 is placed over a driven roller 10 on the upstream side and the drive roller 11 on the downstream side. When the clockwise rotation of the intermediate transfer belt 8 is started by the rotation of the drive roller 11 with a drive motor (not shown), the transfer paper P is conveyed from the registration roller pair 12*b* with predetermined timing to the nip portion (secondary transfer nip portion) between the drive roller 11 and the secondary transfer roller 9 provided adjacent thereto, and thus the full-color image on the intermediate transfer belt 8 is secondarily transferred on the transfer paper P. The transfer paper P on which the toner images are secondarily transferred is conveyed to the fixing portion 13.

The transfer paper P conveyed to the fixing portion 13 is heated and pressurized with a fixing roller pair 13*a*, and thus the toner images are fixed on the surface of the transfer paper P, with the result that the predetermined full-color image is formed. In the transfer paper P on which the full-color image is formed, the conveying direction thereof is switched with a branch portion 14 that is branched in a plurality of directions, and thus the transfer paper P is ejected with an ejection roller pair 15 to an ejection tray 17 without being processed (or after being fed to a double-sided conveying path 18 where images are formed on both the sides).

Furthermore, an image density sensor 40 is arranged in a position opposite the drive roller 11 through the intermediate transfer belt 8. As the image density sensor 40, an optical sensor is generally used which includes a light emitting element formed with an LED or the like and a light receiving element formed with a photodiode or the like. When the amount of toner adhered on the intermediate transfer belt 8 is measured, measurement light is applied from the light emitting element to individual reference images formed on the intermediate transfer belt 8, and thus the measurement light enters the light receiving element as light which is reflected off the toner and light which is reflected off the surface of the belt.

The light reflected from the toner and the surface of the belt includes specular light and diffuse light. The specular light and the diffuse light are separated with a polarization separation prism, and thereafter respectively enter separate light emitting elements. The individual light emitting elements perform photoelectric conversion on the specular light and the diffuse light which are received, and output output signals to a main control portion 80 (see FIG. 3). Then, the amount of toner is detected from changes in the characteristics of the output signals of the specular light and the diffuse light, a comparison is made with a previously determined reference density and the characteristic value of a development voltage or the like is adjusted, with the result a density correction (calibration) is performed on each of the colors.

Figure 2:
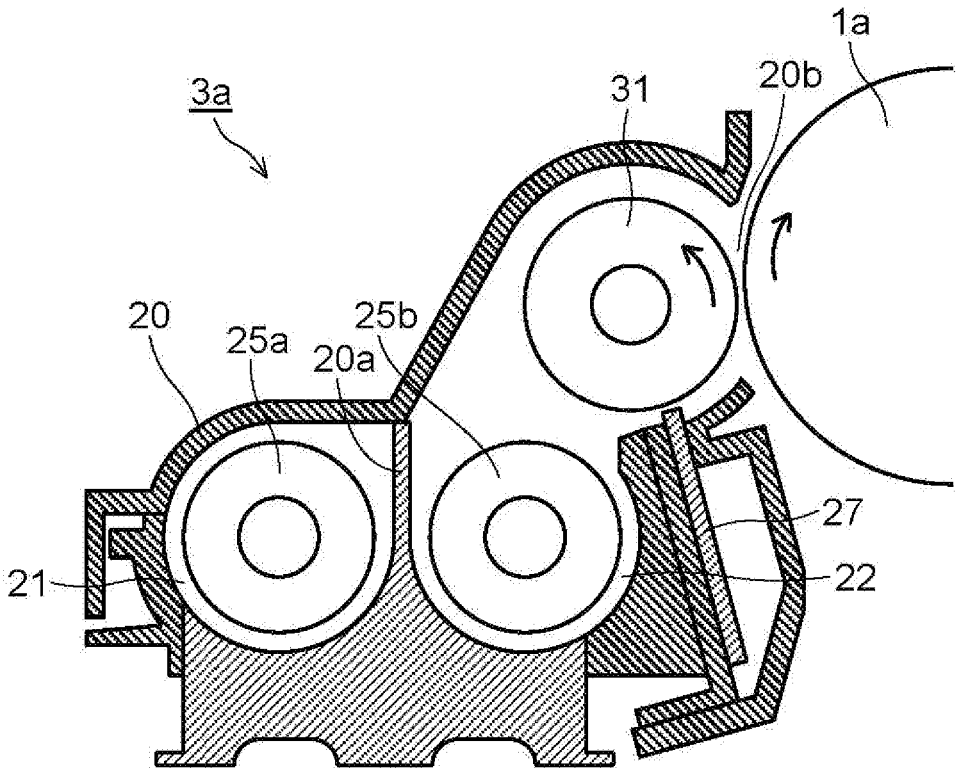
FIG. 2 is a side cross-sectional view of a developing device incorporated in the image forming apparatus.

FIG. 2 is a side cross-sectional view of the developing device 3*a* incorporated in the image forming apparatus 100. FIG. 2 shows a state which is seen from the back side of the plane of FIG. 1, and the arrangement of individual members within the developing device 3*a* are opposite to those in FIG. 1 in a lateral direction. Although in the following description, the developing device 3*a* arranged in the image forming portion Pa of FIG. 1 is illustrated, the same is basically true for the configurations of the developing devices 3*b* to 3*d* arranged in the image forming portions Pb to Pd, and thus the description thereof will be omitted.

As shown in FIG. 2, the developing device 3*a* includes a developing container 20 in which the two-component developer (hereinafter simply referred to as the developer) including the magnetic carrier and the toner is stored, the developing container 20 is partitioned with a partition wall 20*a* into a stirring conveying chamber 21 and a supply conveying chamber 22. In the stirring conveying chamber 21 and the supply conveying chamber 22, a stirring conveying screw 25*a* and a supply conveying screw 25*b* for mixing the toner supplied from the toner container 4*a* (see FIG. 1) with the magnetic carrier and agenting and charging the mixture are respectively and rotatably arranged.

Then, the developer is conveyed in an axial direction (direction perpendicular to the plane of FIG. 2) while being stirred with the stirring conveying screw 25*a* and the supply conveying screw 25*b*, and is circulated between the stirring conveying chamber 21 and the supply conveying chamber 22 through unillustrated developer passages which are formed in both end portions of the partition wall 20*a*. In other words, the stirring conveying chamber 21, the supply conveying chamber 22 and the developer passages form the circulation path of the developer within the developing container 20.

The developing container 20 is extended obliquely upward to the right in FIG. 2, and a developing roller 31 is arranged obliquely upward to the right with respect to the supply conveying screw 25*b* within the developing container 20. Then, part of the outer circumferential surface of the developing roller 31 is exposed from the opening portion 20*b* of the developing container 20 and is opposite the photosensitive drum 1*a*. The developing roller 31 is rotated in the counterclockwise direction of FIG. 2.

The developing roller 31 is formed with: a cylindrical developing sleeve which is rotated in the counterclockwise direction of FIG. 2; and a magnet (not shown) which is fixed within the developing sleeve and which has a plurality of magnetic poles. Although here, the developing sleeve whose surface is knurled is used, a developing sleeve in which a large number of convex shapes (dimples) are formed in its surface, a developing sleeve whose surface is subjected to blast processing, a developing sleeve whose surface is subjected to blast processing in addition to knurling and the formation of convex shapes or a developing sleeve on which plating processing is performed can be used.

A regulation blade 27 is attached to the developing container 20 along the longitudinal direction (direction perpendicular to the plane of FIG. 2) of the developing roller 31. Between the tip end portion of the regulation blade 27 and the surface of the developing roller 31, a slight gap is formed.

The development voltage formed with a direct-current voltage (hereinafter referred to as Vslv (DC)) and an alternating-current voltage (hereinafter referred to as Vslv (AC)) is applied to the developing roller 31 with a high-voltage generation circuit 43 (see FIG. 3).

Figure 3:
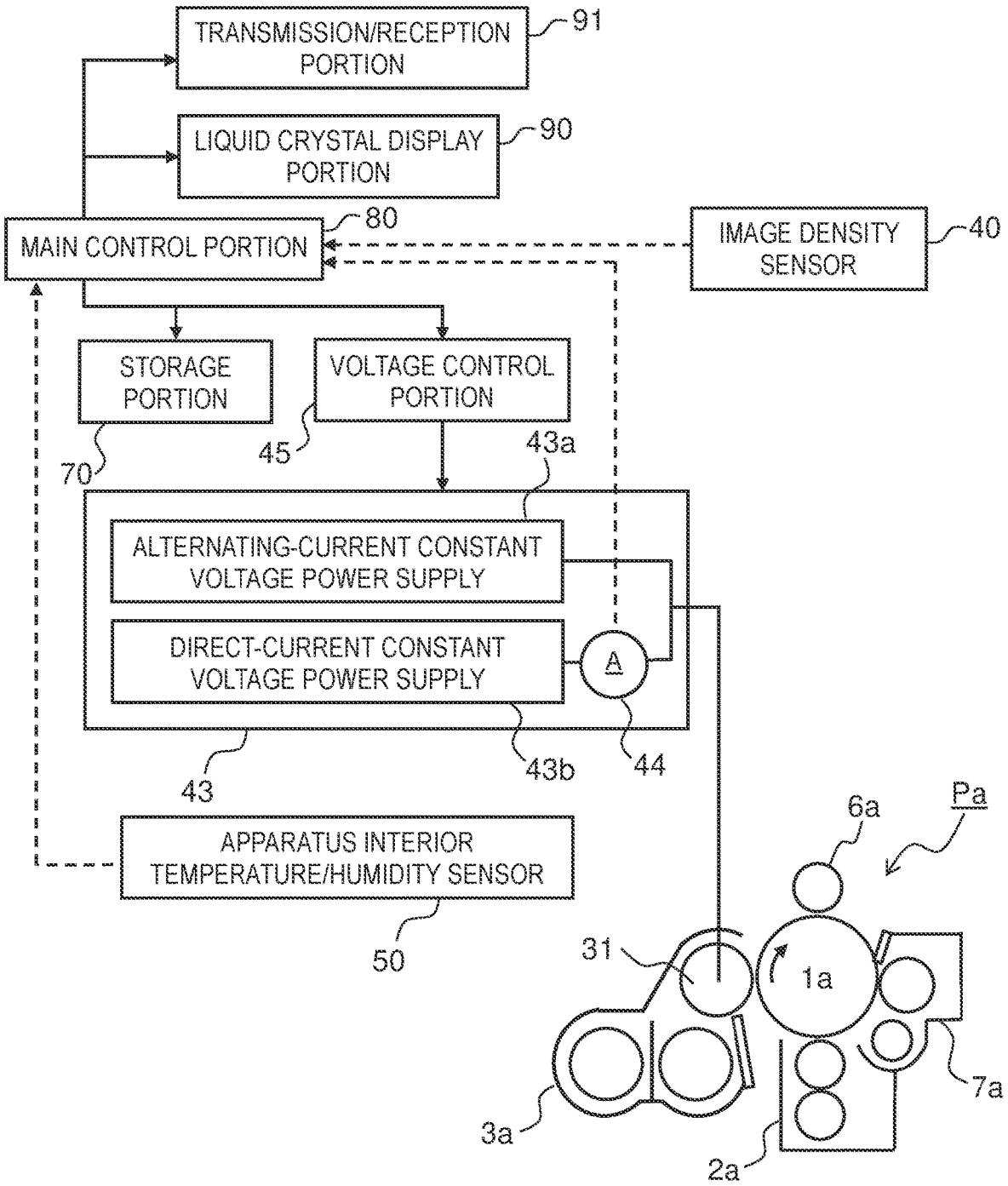
FIG. 3 is a partial enlarged view in the vicinity of an image forming portion which includes the control path of the developing device.

FIG. 3 is a partial enlarged view in the vicinity of the image forming portion Pa which includes the control path of the developing device 3*a*. Although in the following description, the configuration of the image forming portion Pa and the control path of the developing device 3*a* are discussed, the same is true for the configurations of the image forming portions Pb to Pd and the control paths of the developing devices 3*b* to 3*d*, and thus the description thereof will be omitted.

The developing roller 31 is connected to the high-voltage generation circuit 43 that generates an oscillation voltage in which the direct-current voltage and the alternating-current voltage are superimposed on each other. The high-voltage generation circuit 43 includes an alternating-current constant voltage power supply 43*a* and a direct-current constant voltage power supply 43*b*. The alternating-current constant voltage power supply 43*a* outputs a sinusoidal alternating-current voltage generated from a low voltage direct-current voltage which is modulated with a step-up transformer (not shown) so as to be pulse-shaped. The direct-current constant voltage power supply 43*b* outputs a direct-current voltage obtained by rectifying the sinusoidal alternating-current voltage generated from the low voltage direct-current voltage which is modulated with the step-up transformer so as to be pulse-shaped.

At the time of image formation, the high-voltage generation circuit 43 outputs, from the alternating-current constant voltage power supply 43*a* and the direct-current constant voltage power supply 43*b*, the development voltage in which the alternating-current voltage is superimposed on the direct-current voltage. A current detection portion 44 detects a direct current value which flows between the developing roller 31 and the photosensitive drum 1*a*.

The control system of the image forming apparatus 100 will then be described with reference to FIG. 3. In the image forming apparatus 100, the main control portion 80 is provided which is formed with a CPU and the like. The main control portion 80 is connected to a storage portion 70 which is formed with a ROM, a RAM and the like. The main control portion 80 controls, based on control programs and control data stored in the storage portion 70, the individual portions of the image forming apparatus 100 (the charging devices 2*a* to 2*d*, the exposure device 5, the developing devices 3*a* to 3*d*, the primary transfer rollers 6*a* to 6*d*, the cleaning devices 7*a* to 7*d*, the fixing portion 13, the high-voltage generation circuit 43, the current detection portion 44, a voltage control portion 45 and the like).

The voltage control portion 45 controls the high-voltage generation circuit 43 which applies the development voltage to the developing roller 31 and which applies the transfer voltage to the primary transfer rollers 6*a* to 6*d* and the secondary transfer roller 9. The voltage control portion 45 may be formed with the control programs stored in the storage portion 70. An apparatus interior temperature/humidity sensor 50 constantly detects the temperature and humidity of the interior of the image forming apparatus 100 and specifically, the vicinity of the photosensitive drums 1*a* to 1*d*, and the detected temperature and humidity are transmitted to the main control portion 80.

A liquid crystal display portion 90 and a transmission/reception portion 91 are connected to the main control portion 80. The liquid crystal display portion 90 functions as a touch panel for performing various types of settings of the image forming apparatus 100 by a user, and displays the state of the image forming apparatus 100, the status of image formation, the number of printed sheets and the like. The transmission/reception portion 91 uses a telephone line or an Internet line so as to communicate with the outside.

The image forming apparatus 100 of the present disclosure can measure the amount of charge of the toner based on the development current and the amount of development of the toner, and perform a transfer memory prediction mode in which the level of occurrence of transfer memory is predicted from the measured amount of charge of the toner.

Although in the transfer memory prediction mode, the occurrence of the transfer memory is predicted based on the amount of charge of the toner and the actual measurement value of the direct-current component of the development current, and thus the accuracy thereof is high, when the transfer memory prediction mode is frequently performed, the efficiency of image formation in the image forming apparatus 100 is lowered. On the other hand, when a performance interval is excessively increased, in the meantime, changes in the amount of charge of the toner and the development current are produced, with the result that image quality may be degraded. Hence, the transfer memory prediction mode needs to be performed at appropriate intervals.

Hence, in the present disclosure, as a method of predicting the level of occurrence of the transfer memory, attention is focused on the development current of a non-image portion. The development current of the non-image portion in the present specification refers to a current flowing through the developing rollers 31 when the non-image portions (margin portions) of the photosensitive drums 1*a* to 1*d* are opposite the developing rollers 31 at the time of image formation. In the image forming apparatus 100 of the present embodiment, the direct-current component of the development current of the non-image portion at the time of normal printing is measured, and when the direct-current component of the development current exceeds a predetermined value, the transfer memory prediction mode is performed.

Although the amount of charge of the toner cannot be measured at the time of normal printing, the concentration of the toner and the temperature and humidity within the apparatus can be measured. Hence, even at the time of normal image formation (normal printing mode), the data of the direct-current component of the development current of the non-image portions, the concentrations of the toners within the developing devices 3*a* to 3*d* and the temperature and humidity within the apparatus is utilized, and thus the level of occurrence of the transfer memory is predicted, with the result that it is possible to change image formation conditions.

Figure 4:
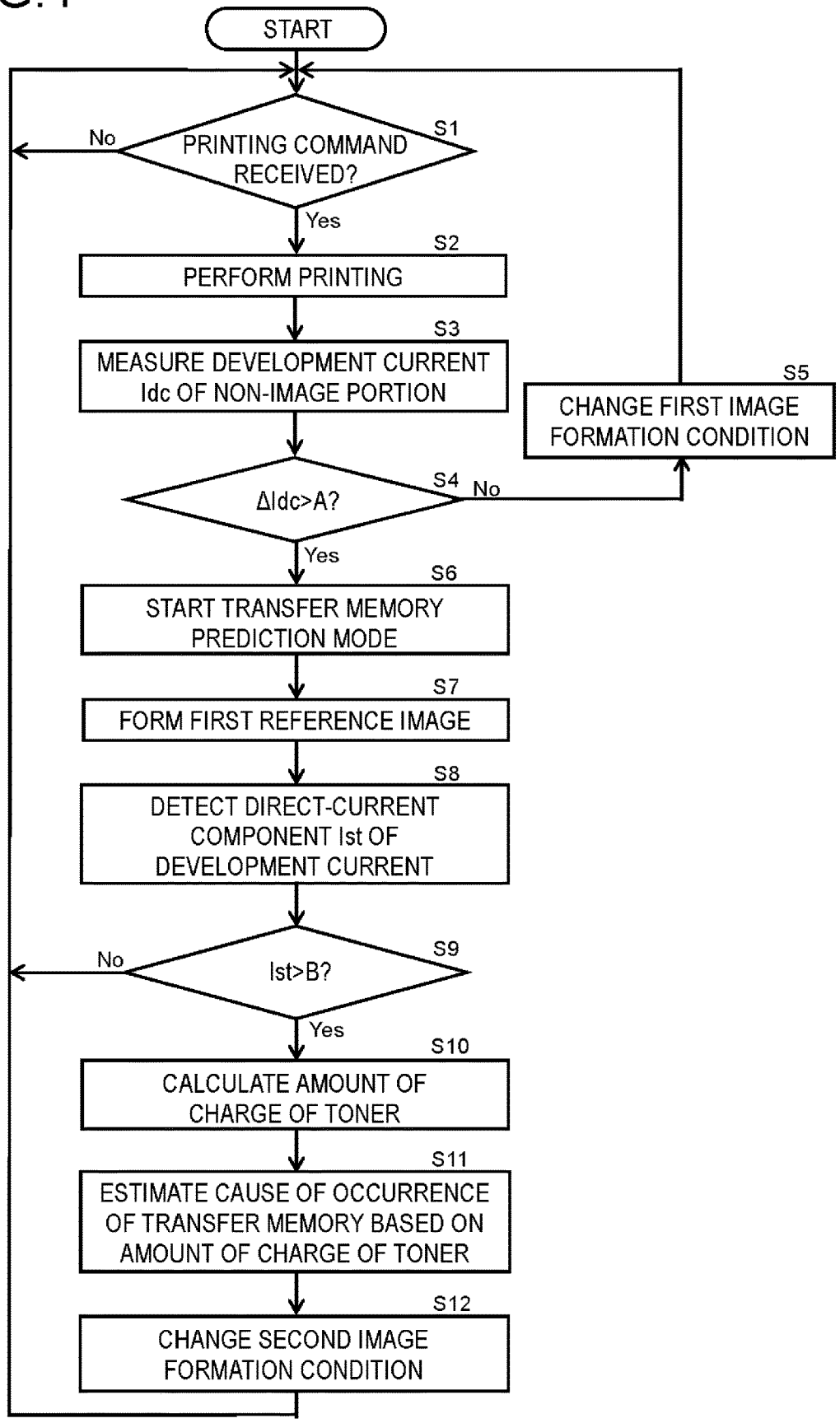
FIG. 4 is a flowchart showing an example of control of a transfer memory prediction mode in the image forming apparatus of the present embodiment.

FIG. 4 is a flowchart showing an example of control of the transfer memory prediction mode in the image forming apparatus 100 of the present embodiment. The procedure of the performance of the transfer memory prediction mode will be described in detail along the steps of FIG. 4 with reference to FIGS. 1 to 3 and FIG. 5 to be described later as necessary.

In FIG. 4, the color printer 100 is set to a normal printing mode, and the main control portion 80 determines whether or not a printing command is received (step S1). When the printing command is received (yes in step S1), printing is performed by a normal image formation operation (step S2). Then, the direct-current component Idc of the development current of the non-image portion at the time of printing is measured (step S3). The direct-current component Idc of the development current which is measured is transmitted to the main control portion 80.

Then, the main control portion 80 determines whether or not the amount of change ΔIdc in the direct-current component Idc of the development current which is transmitted exceeds a predetermined value A (here, 0.03 μA) (step S4). When ΔIdc≤A (no in step S4), based on the direct-current component Idc of the development current, a first image formation condition is changed (step S5). As the first image formation condition which is changed, the direct-current component Vdc of the development voltage or the like can be mentioned. Thereafter, the process is returned to step S1, and a standby state for the printing command is continued. Steps S1 to S5 can be regarded as the control of prediction of the level of occurrence of the transfer memory in the normal printing mode.

When ΔIdc>A (yes in step S4), the transfer memory prediction mode is started (step S6). In the transfer memory prediction mode, the surfaces of the photosensitive drums 1*a* to 1*d* are first charged with the charging devices 2*a* to 2*d*, and thereafter the electrostatic latent images of first reference images are formed with the exposure device 5 on the photosensitive drums 1*a* to 1*d*. Then, with the high-voltage generation circuit 43, the development voltage is applied to the developing rollers 31 so as to develop the electrostatic latent images into toner images, and thus the first reference images (solid images) are formed on the photosensitive drums 1*a* to 1*d* (step S7). Then, with the current detection portion 44, the direct-current component Ist of the development current when the first reference images are formed is detected (step S8), and whether or not the direct-current component Ist is larger than a reference value B is determined (step S9). When Ist≤B (no in step S9), the transfer memory prediction mode is completed, the process is returned to step S1 and the standby state for the printing command is continued.

Figure 5:
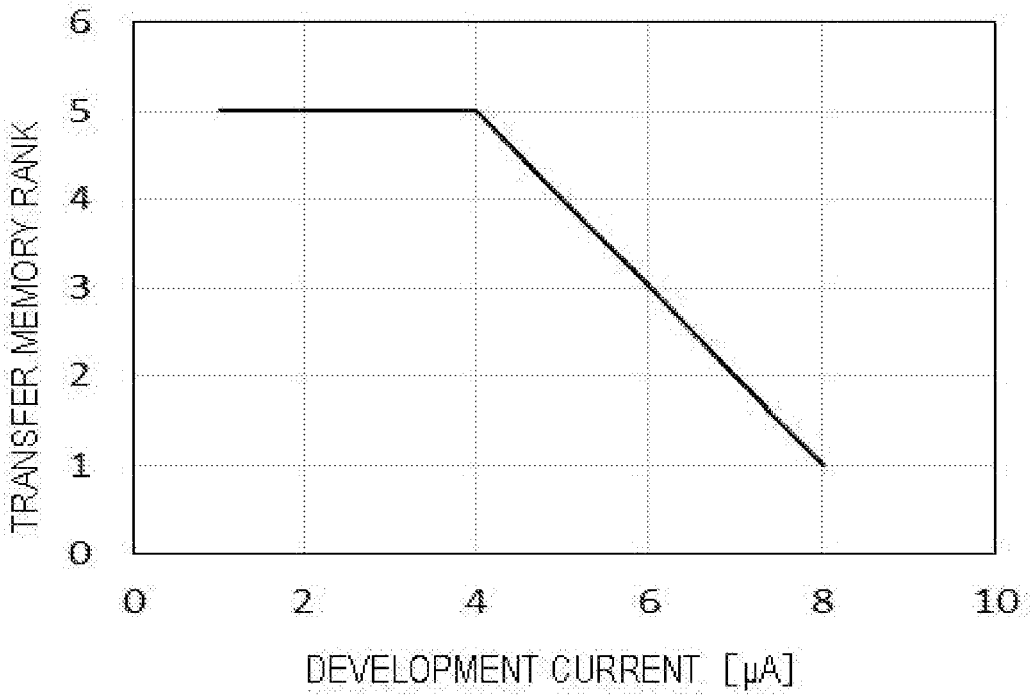
FIG. 5 is a graph showing a relationship between the direct-current component of a development current and the level of occurrence of a transfer memory when first reference images are formed.

FIG. 5 is a graph showing a relationship between the direct-current component of the development current and the level of occurrence of the transfer memory when the first reference images are formed. Transfer memory ranks are set such that a case where the transfer memory does not occur is rank 5, that a case where the transfer memory slightly occurs is rank 4, that a case where the transfer memory occurs but is not noticeable is rank 3, that a case where the transfer memory occurs and is slightly noticeable is rank 2 and that a case where the transfer memory occurs and is significantly noticeable is rank 1. As shown in FIG. 5, when the direct-current component of the development current is equal to or more than a constant value, the transfer memory occurs, and thus when the direct-current component of the development current detected with the current detection portion 44 exceeds the reference value B (in FIG. 5, 4 μA), it can be estimated that the transfer memory occurs.

When Ist>B (yes in step S9), the amounts of charge of the toners within the developing devices 3*a* to 3*d* are calculated (step S10). Specifically, with the charging devices 2*a* to 2*d*, the surfaces of the photosensitive drums 1*a* to 1*d* are charged, and thereafter the electrostatic latent images of second reference images are formed with the exposure device 5 on the photosensitive drums 1*a* to 1*d*. Then, with the high-voltage generation circuit 43, the development voltage is applied to the developing rollers 31 so as to develop the electrostatic latent images into toner images, and thus a plurality of second reference images whose printing rates are different are formed on the photosensitive drums 1*a* to 1*d*. At the same time, with the current detection portion 44, the direct-current component of the development current flowing through the developing rollers 31 is detected.

Then, a predetermined primary transfer voltage is applied to the primary transfer rollers 6*a* to 6*d* so as to transfer the second reference images on the intermediate transfer belt 8. Then, with the image density sensor 40, the densities of the second reference images are detected. The main control portion 80 calculates the amounts of charge of the toners based on the development current and the densities of the second reference images (the amounts of development of the toners) which are detected.

Figure 6:
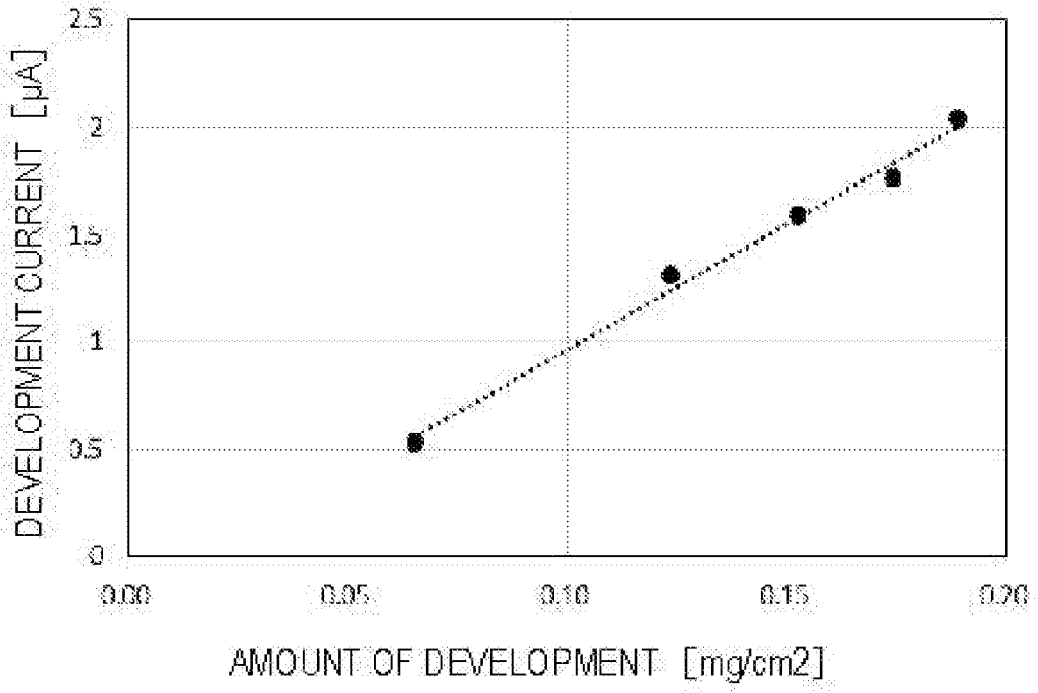
FIG. 6 is a graph showing a relationship between the amount of development and the development current when second reference images whose printing rates are different are formed.

FIG. 6 is a graph showing a relationship between the amount of development of the toner and the development current when the second reference images whose printing rates are different are formed. The amount of charge of the toner can be determined from the slope of an approximate straight line (y=11.722x−0.2079) indicated by a dotted line in FIG. 6. In an actual calculation, it is necessary to calculate the amount of current [$\mu A/cm^2$] per unit area by dividing the development current by a measurement area. When the image density is measured at a plurality of parts of the one second reference image, and the average value of the individual measurement values is used, an error is reduced.

Then, with reference back to FIG. 4, the main control portion 80 estimates the cause of occurrence of the transfer memory based on the amount of charge of the toner (step S11). The transfer memory easily occurs when the amount of charge of the toner is high or when the amount of development of the toner is large. Hence, when the amount of charge of the toner is found, the cause of occurrence of the transfer memory can be estimated. Specifically, when the amount of charge of the toner which is measured is high, it is estimated that the cause of occurrence of the transfer memory is the high amount of charge of the toner. On the other hand, when the amount of charge of the toner which is measured is low, it is estimated that the cause of occurrence of the transfer memory is the large amount of development of the toner.

The main control portion 80 changes the second image formation condition based on the result of the estimation of the cause of occurrence of the transfer memory (step S12), and completes the transfer memory prediction mode. As the second image formation condition which is changed, the concentrations of the toners in the developers within the developing devices 3*a* to 3*d* (the ratios of the toners to the carriers) and Vpp (peak-to-peak value) of the alternating-current component of the development voltage applied to the developing rollers 31 can be mentioned. Specifically, when the amount of charge of the toner is higher than a predetermined value (threshold value), it is estimated that the cause of occurrence of the transfer memory is the amount of charge of the toner, and thus the concentration of the toner is increased so as to lower the amount of charge of the toner. When the amount of charge of the toner is equal to or less than the predetermined value (threshold value), it is estimated that the cause of occurrence of the transfer memory is the amount of development of the toner, and thus Vpp of the alternating-current component of the development voltage is lowered so as to reduce the occurrence of the transfer memory.

As described above, the transfer memory prediction mode is performed in which the development current is used to estimate the level of occurrence of the transfer memory and in which the amount of charge of the toner is used to estimate the cause of occurrence of the transfer memory, and thus it is possible to accurately estimate the cause of occurrence of the transfer memory and to thereby set appropriate image formation conditions under which the transfer memory is prevented from occurring. Hence, it is possible to effectively reduce an image failure caused by the transfer memory.

The current value of the direct-current component of the development current of the non-image portion at the time of image formation is used to predict the level of occurrence of the transfer memory, and only when it is estimated that the level of occurrence of the transfer memory is high, the transfer memory prediction mode is performed, with the result that it is possible to perform the transfer memory prediction mode with appropriate timing. Hence, it is possible to effectively reduce an image failure caused by the occurrence of the transfer memory while minimizing increases in the consumed toner and the consumed power and a decrease in the efficiency of image formation which result from the unnecessary performance of the transfer memory prediction mode.

When the transfer memory prediction mode is not performed, the first image formation condition (the direct-current component Vdc of the development voltage) is changed while the normal printing mode is being continued, and thus it is possible to take an immediately effective measure for a short-term change in the level of occurrence of the transfer memory. As will be found from Example to be described later, the second image formation condition is only changed, and thus an effect of reducing the transfer memory is sufficiently obtained, with the result that the change of the first image formation condition (step S5 in FIG. 4) may be omitted.

The present disclosure is not limited to the embodiment described above, and various modifications are possible without departing from the spirit of the present disclosure. For example, although in the embodiment described above, a plurality of measurement patterns whose image densities (printing rates) are different are formed, and the amounts of charge of the toners are measured based on the relationship between the difference of the amounts of development (the difference of the densities) in the individual measurement patterns and the difference of the development currents flowing when the measurement patterns are formed, the method of measuring the amounts of charge of the toners is not limited to the method described above. For example, a method can be used in which the electrostatic latent image of the same measurement pattern is developed into toner images by switching of the frequency of the alternating-current component of the development voltage so as to form two types of measurement patterns and in which the amounts of charge of the toners are measured based on a relationship among the difference of the development currents flowing when the individual measurement patterns are formed, the difference of the amounts of development (the difference of the densities) and the measurement patterns or a method can be used in which the amounts of charge of the toners are measured based on a relationship between the frequency and the difference of the amounts of development (the difference of the densities).

Although in the embodiment described above, the image forming apparatus 100 is described which includes the developing devices 3*a* to 3*d* of a two-component development type including the developing rollers 31 for carrying the two-component developers, the developing devices are not limited to the two-component development type. For example, in an image forming apparatus 100 which includes developing devices of a one-component development type using one-component developers formed of only toners, the present disclosure can likewise be applied.

Although in the description of the embodiment discussed above, the color printer as shown in FIG. 1 is used as an example of the image forming apparatus 100, the image forming apparatus 100 is not limited to the color printer, and may be an image forming apparatus such as a monochrome or color copying machine, a digital multifunctional peripheral or a facsimile machine. The effect of the present disclosure will be described in more detail below using Example.

EXAMPLE

A verification test was performed on an effect of reducing transfer memory when the transfer memory prediction mode shown in FIG. 4 was performed and the image formation conditions were changed based on the level of occurrence of the transfer memory and the cause of occurrence thereof which were estimated. As the conditions of a testing machine, in the image forming apparatus 100 as shown in FIG. 1, the photosensitive drums 1*a* to 1*d* including amorphous silicon (a-Si) photosensitive layers were used, and settings were made such that non-exposure portion potential V0=270V and that exposure portion potential VL=20V. A drum linear speed (process speed) was set to 55 sheets/min.

In the developing devices 3*a* to 3*d*, the developing rollers 31 were used in which concave portions of 80 rows were formed in a circumferential direction by knurling and whose diameters were 20 mm, and as the regulation blades 27, magnetic material blades formed of stainless steel (SUS430) were used. The amounts of developers conveyed with the developing rollers 31 were set to 250 g/m$^2$. The circumferential speed ratios between the developing rollers 31 and the photosensitive drums 1*a* to 1*d* were set to 1.8 (at an opposite position, trail rotation), and the distances between the developing rollers 31 and the photosensitive drums 1*a* to 1*d* were set to 0.30 mm. As the development voltage, a voltage in which a rectangular alternating-current voltage having a frequency of 4.2 kHz and a duty of 50% was superimposed on a direct-current voltage Vslv (DC) of 170V was applied to the developing rollers 31.

Two-component developers formed with a positively charged toner having an average particle diameter of 6.8 μm and a ferrite/resin coat carrier having an average particle diameter of 35 μm were used, and the concentrations of the toners were set to 8%.

As a testing method, in a case where the second image condition was changed such that the concentrations of the toners within the developing devices 3*a* to 3*d* were increased or Vpp of the alternating-current component of the development voltage was lowered according to the cause of occurrence of the transfer memory (present disclosure 1), in a case where in addition to the second image formation condition, the first image condition was changed such that Vdc of the direct-current component of the development voltage was lowered (present disclosure 2) and in a case where the image conditions were not changed (Comparative Example 1), 220 thousand sheets were durably printed, and the level of occurrence of the transfer memory was evaluated. The evaluation of the transfer memory was a sensory evaluation (visual inspection), as a test image, a solid image was printed and thereafter a 25% half image was printed and the level of occurrence of the transfer memory was evaluated with the same evaluation criteria as in FIG. 5. The results thereof are shown in FIG. 7.

Figure 7:
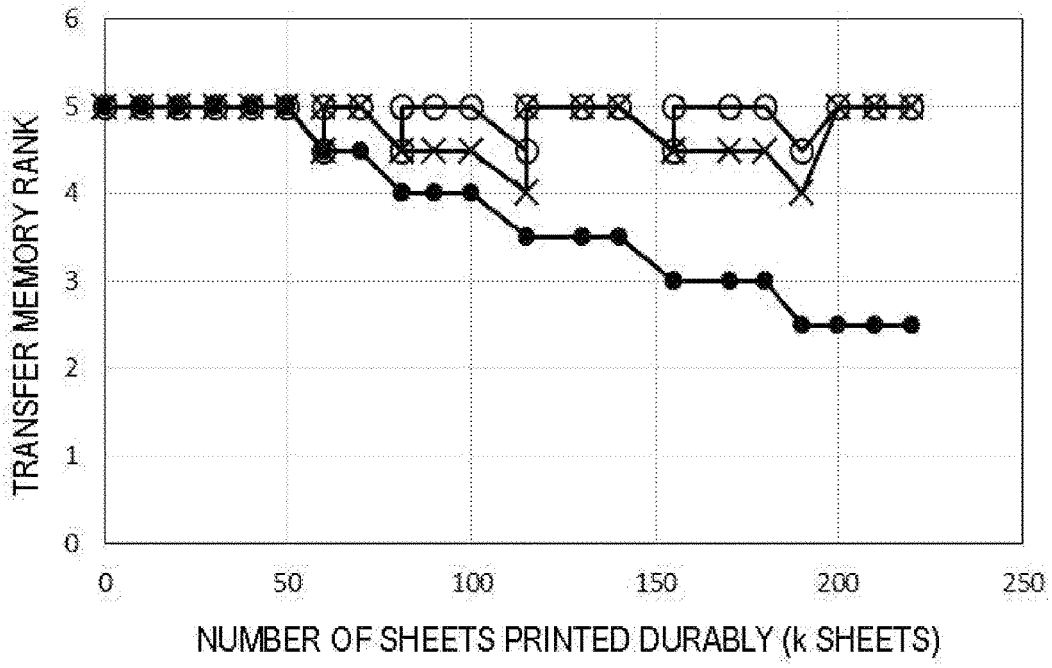
FIG. 7 is a graph showing, in Example, the progress of transfer memory levels when durable printing was performed in a case where the transfer memory prediction mode was performed and where a first image formation condition or a second image formation condition was changed (present disclosure 1, 2) and in a case where the first and second image formation conditions were not changed (Comparative Example 1)
Figure 8A:
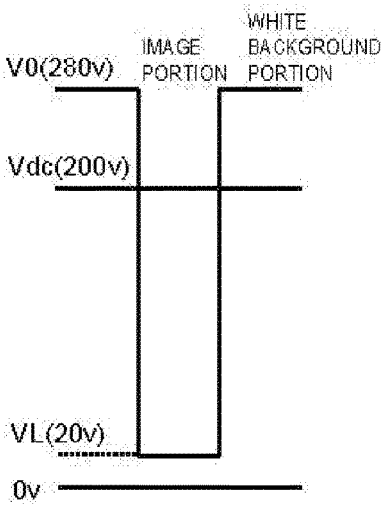
Related art FIG.8A
FIG. 8A is a schematic view showing the surface potentials of an image portion and a white background portion (non-exposure portion) in a development step.
Figure 8B:
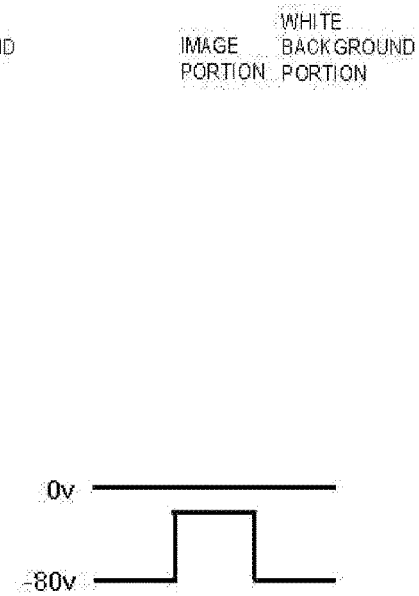
Related art FIG.8B
FIG. 8B is a schematic view showing the surface potentials of the image portion and the white background portion (non-exposure portion) in a transfer step.
Figure 8C:
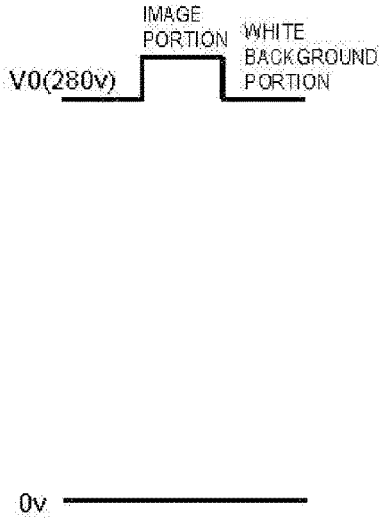
Related art FIG.8C
FIG. 8C is a schematic view showing the surface potentials of the image portion and the white background portion (non-exposure portion) in a charging step.
Figure 9A:
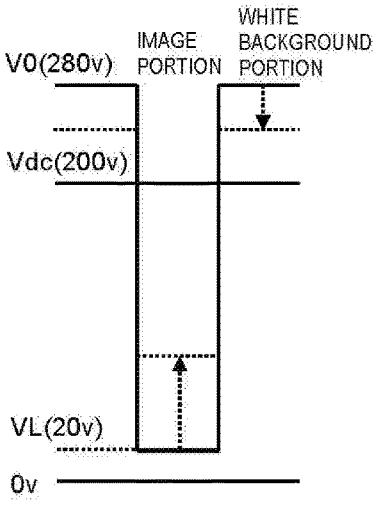
Related art FIG.9A
FIG. 9A is a schematic view showing the surface potentials of the image portion and the white background portion (non-exposure portion) in the development step when the development current easily flows.
Figure 9B:
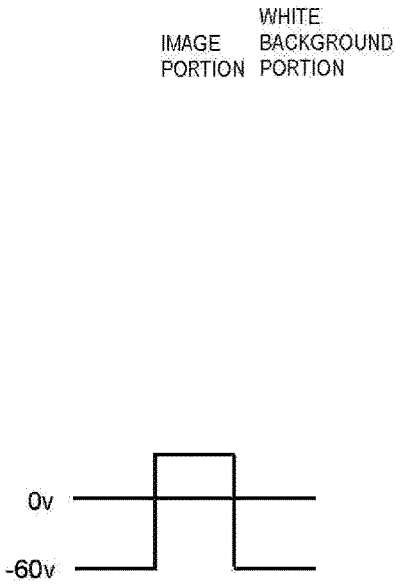
Related art FIG.9B
FIG. 9B is a schematic view showing the surface potentials of the image portion and the white background portion (non-exposure portion) in the transfer step when the development current easily flows.
Figure 9C:
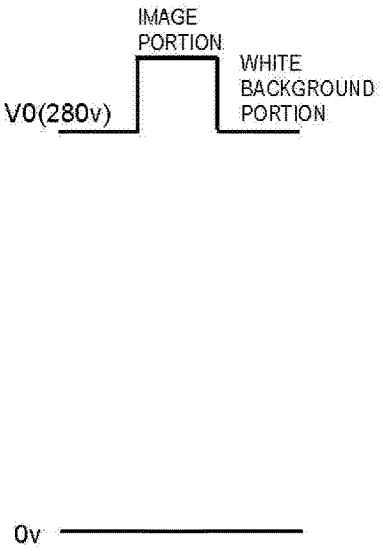
Related art FIG.9C
FIG. 9C is a schematic view showing the surface potentials of the image portion and the white background portion (non-exposure portion) in the charging step when the development current easily flows.

As is clear from FIG. 7, in present disclosure 1 (the data series of x in FIG. 7) in which the second image formation condition was changed according to the cause of occurrence of the transfer memory, the level of occurrence of the transfer memory after 220 thousand sheets were durably printed was rank 4 at the maximum, and the transfer memory slightly occurred. In present disclosure 2 (the data series of ○ in FIG. 7) in which in addition to the second image formation condition, the first image condition was changed, the level of occurrence of the transfer memory after 220 thousand sheets were durably printed was rank 4.5 at the maximum, and either the transfer memory did not occur or the transfer memory slightly occurred.

By contrast, in Comparative Example 1 (the data series of • in FIG. 7) in which the image formation conditions were not changed, the level of occurrence of the transfer memory after 220 thousand sheets were durably printed was rank 2.5 at the maximum, and the transfer memory occurred but either the transfer memory was not noticeable or the transfer memory was slightly noticeable.

The present disclosure can be utilized for image forming apparatuses of an electrophotographic system. By utilization of the present disclosure, the transfer memory prediction mode is performed in which the development current and the amount of charge of the toner are used to be able to accurately estimate the level of occurrence of the transfer memory and the cause of occurrence thereof, and the image formation conditions are changed based on the result of the estimation, with the result that it is possible to provide the image forming apparatus in which appropriate image formation conditions corresponding to the cause of occurrence of the transfer memory can be set.

What is claimed is:

1. An image forming apparatus comprising:

an image forming portion that includes an image carrying member in which a photosensitive layer is formed on a surface, a charging device which charges the image carrying member, an exposure device which exposes the image carrying member charged with the charging device so as to form an electrostatic latent image and a developing device which includes a developer carrying member that is arranged opposite the image carrying member and that carries a developer including a toner and which adheres the toner to the electrostatic latent image formed on the image carrying member so as to form a toner image, a high-voltage generation circuit that applies, to the developer carrying member, a development voltage in which an alternating-current voltage is superimposed on a direct-current voltage;

a current detection portion that detects a direct-current component of a development current which flows when the development voltage is applied to the developer carrying member; and a control portion that controls the image forming portion and the high-voltage generation circuit, wherein the control portion can perform a transfer memory prediction mode that includes a step of estimating, when a first reference image is formed, a level of occurrence of transfer memory based on the direct-current component of the development current flowing through the developer carrying member and a step of measuring, when the measured direct-current component of the development current is larger than a predetermined value, an amount of charge of the toner within the developing device and estimating a cause of occurrence of the transfer memory based on the measured amount of charge of the toner.

2. The image forming apparatus according to claim 1, wherein when an amount of change in the direct-current component of the development current is equal to or less than a predetermined value, the control portion does not perform the transfer memory prediction mode and changes a first image formation condition.

3. The image forming apparatus according to claim 2, wherein when the amount of change in the direct-current component of the development current is equal to or less than the predetermined value, the control portion changes a direct-current component of the development voltage as the first image condition.

4. The image forming apparatus according to claim 1, wherein the transfer memory prediction mode includes a step of changing a second image formation condition according to the level of occurrence of the transfer memory and the cause of occurrence thereof which are estimated.

5. The image forming apparatus according to claim 4, wherein the developer is a two-component developer which includes a carrier and the toner, and when the amount of charge of the toner is higher than a predetermined value, the control portion increases, as the second image condition, a concentration of the toner in the developer within the developing device.

6. The image forming apparatus according to claim 4, wherein when the amount of charge of the toner is lower than a predetermined value, the developer lowers, as the second image condition, a peak-to-peak value of an alternating-current component of the development voltage.

7. The image forming apparatus according to claim 1, wherein when a non-image portion of the image carrying member is opposite at a time of image formation, the control portion detects the direct-current component of the development current which flows through the developer carrying member, and when an amount of change in the detected direct-current component of the development current from a time when the direct-current component is previously measured is larger than a predetermined value, the control portion performs the transfer memory prediction mode.

8. The image forming apparatus according to claim 1, comprising:

a density detection device which detects a density of the toner image formed with the developing device, wherein when the direct-current component of the development current is larger than the predetermined value, the control portion forms, with the developing device, on the image carrying member, a plurality of second reference images whose printing rates are different, and acquires a correlation between an amount of development of the toner calculated from densities of the second reference images detected with the density detection device and the direct-current component of the development current detected with the current detection portion when the second reference images are formed, and the amount of charge of the toner is calculated from an amount of change in the direct-current component of the development current with respect to the amount of development of the toner such that the cause of occurrence of the transfer memory is estimated based on the calculated amount of charge of the toner.

* * * * *